US006044804A

United States Patent [19]

Franke et al.

[11] Patent Number: 6,044,804

[45] Date of Patent: Apr. 4, 2000

[54] METHOD AND DEVICE FOR MONITORING A FEEDWATER SUPPLY TO A STEAM GENERATOR

[75] Inventors: Joachim Franke, Altdorf; Eberhard Wittchow, Erlangen, both of Germany

[73] Assignee: Siemens Aktiengesellschaft, Munich, Germany

[21] Appl. No.: 08/931,376

[22] Filed: Sep. 16, 1997

Related U.S. Application Data

[63] Continuation of application No. PCT/DE96/00382, Mar. 4, 1996.

[30] Foreign Application Priority Data

Mar. 16, 1995 [DE] Germany ..... 195 09 082

[51] Int. Cl.[7] ..... F22B 37/47

[52] U.S. Cl. ..... 122/448.1; 122/448.4; 374/42

[58] Field of Search ..... 122/448.1, 448.4; 374/15, 42, 137

[56] References Cited

U.S. PATENT DOCUMENTS

| | | | |
|---|---|---|---|
| 3,596,516 | 8/1971 | Haynes, Jr. et al. | 374/42 |
| 3,942,483 | 3/1976 | Laubli | 122/448.1 |
| 4,074,360 | 2/1978 | Stadie et al. | 122/448.1 |
| 4,516,403 | 5/1985 | Tanaka . | |
| 5,279,263 | 1/1994 | Cameau et al. | 122/448.1 |
| 5,529,021 | 6/1996 | Butterlin et al. | 122/448.1 |

FOREIGN PATENT DOCUMENTS

| | | |
|---|---|---|
| 1172273 | 6/1964 | Germany . |
| 214917 | 11/1972 | Germany . |
| 3243578C2 | 10/1992 | Germany . |
| 93/06416 | 4/1993 | WIPO . |

OTHER PUBLICATIONS

"Comparing Display Integration Strategies for Control of a Simple Steam Plant" (Carl Edlund et al.), IEEE, 1994, pp. 2686–2691.

*Primary Examiner*—Denise L. Ferensic
*Assistant Examiner*—Gregory A. Wilson
*Attorney, Agent, or Firm*—Herbert L. Lerner; Laurence A. Greenberg; Werner H. Stemer

[57] ABSTRACT

A method for monitoring a feed-water supply to a continuous-flow or once-through steam generator, wherein steam temperature of evaporated feedwater is employed for determining a feedwater supply rate in the method, includes indicating an actual value of the steam temperature jointly with a setpoint value thereof obtained from operationally induced parameters, and a device for performing the method.

5 Claims, 1 Drawing Sheet

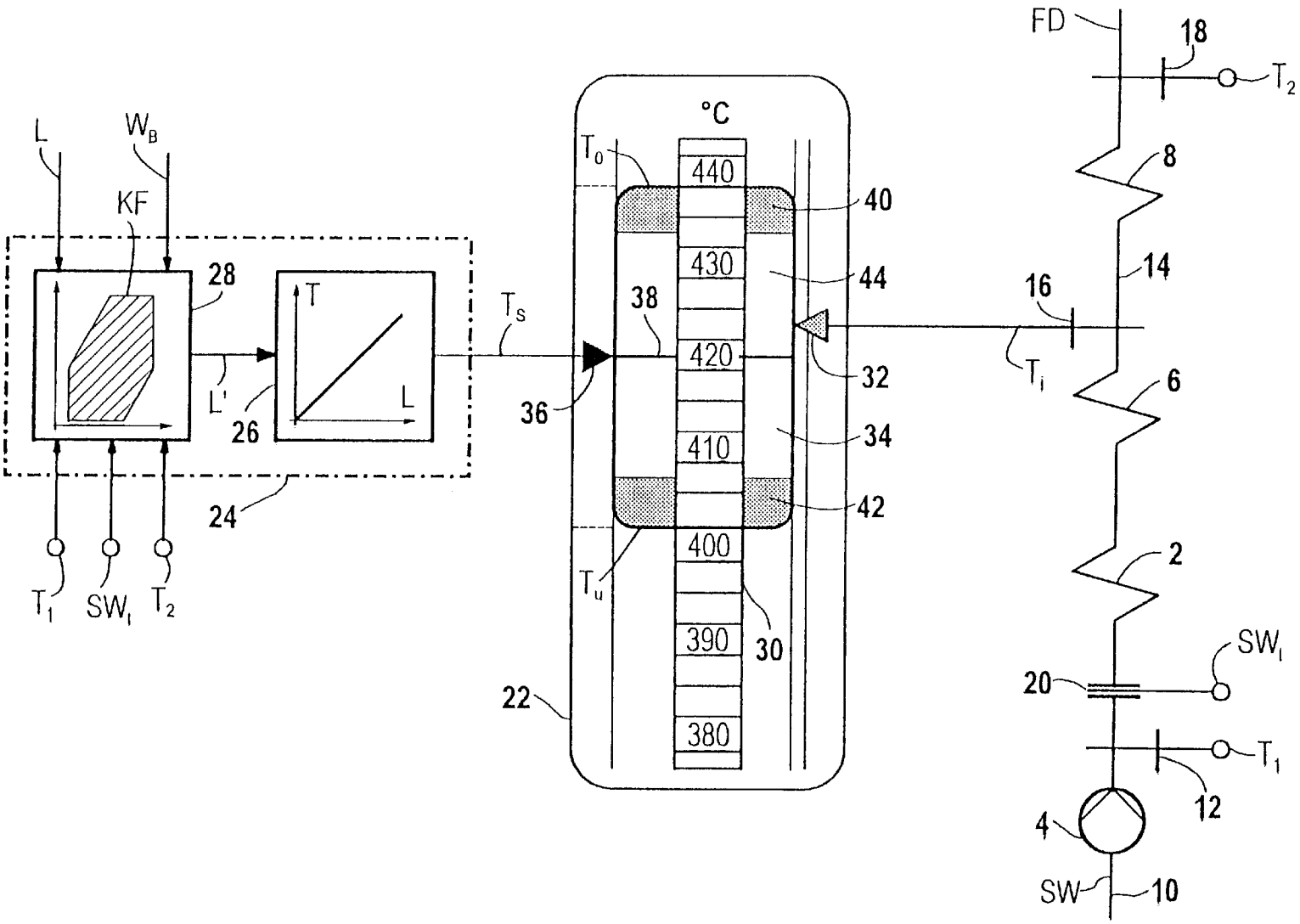
FD
18
$T_2$
8
14
6
2
$SW_1$
$T_1$
12
10
SW
4
20
16
$T_1$
40
44
32
34
42
30
°C
440
430
420
410
400
390
380
38
$T_o$
$T_u$
36
22
$T_s$
T
L
26
L'
24
28
$W_B$
KF
L
$T_2$
$SW_1$
$T_1$

METHOD AND DEVICE FOR MONITORING A FEEDWATER SUPPLY TO A STEAM GENERATOR

CROSS-REFERENCE TO RELATED APPLICATION

This application is a continuation of International Application Serial No. PCT/DE96/00382, filed Mar. 4, 1996.

BACKGROUND OF THE INVENTION

Field of the Invention

The invention relates to a method for monitoring a feedwater supply to a continuous-flow or once-through steam generator, the steam temperature of evaporated feed water being employed for determining the feedwater supply rate in the method. The invention further relates to a device for performing the method.

Whereas, a circulated water/steam mixture evaporates only partially in a natural-circulation steam generator, the heating of vertically arranged evaporator tubes forming gas-tight containment walls of a combustion chamber in a continuous-flow or once-through steam generator leads to a complete evaporation of the flow medium in the evaporator tubes in a single pass.

Continuous-flow or once-through steam generators are conventionally operated, from an automatic control engineering standpoint, in a manner that predetermined nominal or setpoint values for the steam capacity and the outlet temperature of a superheater located downstream of the evaporator are maintained as precisely as possible. The termination or end of evaporation and, therefore, simultaneously, the commencement of steam superheating are not fixed locally. On the contrary, the end of evaporation is initiated independently, inter alia, dependent upon load and upon the condition of contamination of the heating surfaces of the evaporator or superheater as well as upon the fuel/water content. Therefore a marked difference from the natural-circulation steam generator exists, wherein the end of evaporation is fixed in a water/steam separating drum. An indicator for the water level in the drum provides the operating personnel with a measuring instrument by which a sufficient feedwater supply to the natural-circulation steam generator can be monitored.

In contrast therewith, in a continuous-flow or once-through steam generator, the monitoring of a sufficient water supply occurs, for example, via the steam temperature of the evaporated feedwater, a practice which has become known, for example, from the published German Patent document DE 32 43 578 C2. Monitoring may also be effected indirectly, however, in particular, by observing an injected flow of water in the superheater as a measurement value. On the one hand, however, this measurement is not precise because such injected flows of water vary due to operating conditions. On the other hand, a regulating or control action pursuant to a regulation based upon this measurement value is considerably delayed disadvantageously.

SUMMARY OF THE INVENTION

With the foregoing and other objects in view, there is provided, in accordance with one aspect of the invention, a method for monitoring a feedwater supply to a continuous-flow or once-through steam generator, wherein a steam temperature of evaporated feedwater is employed for determining a feedwater supply rate in the method, which comprises indicating an actual value of the steam temperature jointly with a setpoint value thereof obtained from operationally induced parameters.

In accordance with another mode, the method of the invention includes utilizing the steam generator capacity as an operationally induced parameter.

In accordance with a further mode of the method of the invention, the operationally induced parameter is the steam generator capacity or load.

In accordance with another aspect of the invention, there is provided a device for monitoring a feedwater supply to an evaporator of a continuous-flow or once-through steam generator, comprising an indicator device connected to a measuring device for obtaining an actual value of the steam temperature, and to a setpoint value transmitter for obtaining a setpoint value of the steam temperature from operationally induced parameters, and a temperature scale at an outlet of the steam generator, the actual value and the setpoint value of the steam temperature being jointly indicatable on the indicator device.

In accordance with a concomitant feature of the invention, the device includes a temperature window for the setpoint value of the steam temperature superposed on the temperature scale.

Thus, the invention is based on a method and a device for reliably monitoring a sufficient water supply to a continuous-flow or once-through steam generator.

With regard to the method of the invention, the actual value of the steam temperature is indicated jointly with a setpoint value obtained from operationally induced parameters.

By virtue of a simultaneous monitoring of the setpoint value and the actual value of the steam temperature at the end of the evaporation or vaporizing phase, the operating personnel are provided with reliable information regarding the water supply to the continuous-flow or once-through steam generator in a manner analogous to that of the water level of a natural-circulation steam generator. In this regard, setpoint temperature values and actual temperature values which vary continually during operation are compared with one another after the end of the evaporation or vaporization.

In this case, the operationally induced setpoint value of the steam temperature is expediently determined from the steam generator capacity. The setpoint value is preferably formed in dependence upon or as a function of the steam generator load, the composition of the fuel supplied to the continuous-flow steam generator, the degree of contamination of the heating surfaces of the evaporator and/or of the superheater, as well as the feedwater temperature, so that the temperature of the live steam generated in the continuous-flow steam generator remains constant.

With regard to the device for monitoring the feedwater supply to an evaporator of a continuous-flow or once-through steam generator, there is provided, in accordance with the invention, an indicator device having a measuring arrangement for determining the actual value of the steam temperature and connected, furthermore, to a setpoint transmitter or generator for determining the setpoint value for the steam temperature from operationally induced parameters, and which includes, at the exit or outlet of the evaporator, a temperature scale for indicating the steam temperature, both the actual value and the setpoint value of the steam temperature being indicatable jointly on the temperature scale.

Other features which are considered as characteristic for the invention are set forth in the appended claims.

Although the invention is illustrated and described herein as embodied in a method and a device for monitoring a feedwater supply to a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of a drawing.

BRIEF DESCRIPTION OF THE DRAWING

The single FIGURE of the drawing is a diagrammatic and schematic view of a continuous-flow or once-through steam generator to which the device for monitoring a feedwater supply in accordance with the invention is connected.

DESCRIPTION OF THE PREFERRED EMBODIMENTS

Referring now to the figure of the drawing, there is shown therein a steam-temperature monitoring device 22 disposed downstream from an evaporator 6 of a continuous-flow or once-through steam generator.

The continuous-flow or once-through steam generator has a feedwater-preheating heating surface (economizer) 2 which is located in a non-illustrated gas flue. In terms of throughflow, the preheating heating surface 2 is preceded by a feedwater pump 4 and followed by an evaporator heating surface 6 which, in turn, in terms of throughflow, is followed by a superheater heating surface 8. A measuring device 12 for measuring the feedwater temperature $T_1$ is arranged in a line 10 for feedwater SW extending from the feedwater pump 4 to the preheating heating surface 2.

Furthermore, a measuring device 16 for measuring the actual value $T_i$ of the steam temperature at the outlet or exit of the evaporator heating surface 6 is provided at the exit of the evaporator heating surface 6 in a connecting line 14 between the evaporator heating surface 6 and the superheater heating surface 8. Moreover, a measuring device 18 for measuring the temperature $T_2$ of the live steam FD flowing from the superheater heating surface 8 and fed to a non-illustrated steam turbine is provided at the outlet or exit of the superheater heating surface 8. In addition, a measuring device 20 for measuring the feedwater flow $SW_t$ through the feedwater line 10 is arranged in the feedwater line 10 extending from the feedwater pump 4 to the preheating heating surface 2.

To the device 22 for monitoring the quantity of feedwater SW supplied per unit time to the continuous-flow or once-through steam generator, there is assigned a nominal or setpoint-value transmitter 24 which transmits a setpoint value $T_s$ for the steam temperature at the location at which the evaporator heating surface 6 exits to the monitoring device 22. In this regard, the steam-generator capacity or steam-generator load L and a value $W_B$ for the composition of fuel, especially the water content, supplied to the continuous-flow or once-through steam generator are fed as input variables to the setpoint-value transmitter 24. Moreover, the feedwater temperature $T_1$ and the value $SW_t$ for the feed-water mass flow, as well as the actual value for the live-steam temperature $T_2$ are delivered as input variables to the setpoint-value transmitter 24. The setpoint value $T_s$ for the steam temperature at the exit of the evaporator heating surface 6 is formed in dependence upon the parameters L, $T_1$, $T_2$, $W_B$ and $SW_t$, so that the live-steam temperature $T_2$ remains constant.

The setpoint value $T_s$ for the steam temperature at the exit of the evaporator heating surface 6 is extracted from a function generator unit 26 of the setpoint-value transmitter 24. The input value of the function generator unit 26 is the capacity value or load value L' which is derived from the parameters L, B, $SW_t$, $T_1$ and $T_2$ in a computer module 28 of the setpoint-value transmitter 24. The functional relationship between these parameters is implemented in the computer module 28, for example, in the form of characteristic fields or families of characteristic curves KF.

In order to take into account the fact that, in the event of a change in capacity or load, the firing of the continuous-flow or once-through steam generator follows the change in the capacity L only with a delay and, therefore, a steady state for the heat flow into the evaporator heating surface 6 is established only with a delay, the capacity value L' is preferably delayed. At the same time, a delay in the steam temperature $T_i$ at the exit of the evaporator heating surface 6 in the event of a change in the heat flow into the evaporator heating surface 6 is also taken into account, because a mass flow to flow through the evaporator heating surface 6 requires a finite period of time.

A permanently predeterminable function of the load L is stored in the function generator unit 26 for the setpoint values $T_s$ of the steam temperature at the exit of the evaporator heating surface 6 which were determined from respective values for the setpoint temperature $T_s$ obtained during steady-state operation of the continuous-flow or once-through steam generator and which were inputted into the function generator unit 26.

The device 22 serving for monitoring the feedwater supply to the continuous-flow or once-through steam generator is an indicator instrument having a temperature scale 30 which represents the conventional range of, for example, 380° C. to 440° C. of the steam temperature T downstream from the end of the evaporator heating surface 6. A pointer 32 moves on this temperature scale 30 of the indicator instrument and indicates the actual value $T_i$ of the steam temperature at the exit of the evaporator heating surface 6. Moreover, a temperature window 34 moves on this temperature scale 30 and has a temperature band of, for example, ±20 K which extends above and below a line 38, marked by an arrow 36, for the setpoint value $T_s$ of the steam temperature at the exit of the evaporator heating surface 6. This temperature window 34 can be subdivided into the ranges "normal range", "abnormal range" and "critical range" and thereby reproduces different dangerous ranges for a deviation of the actual value $T_i$ from the setpoint value $T_s$. In the exemplary embodiment, within the temperature window 34, a first range 40 below an upper limit temperature $T_o$ and a second range 42 above a lower limit temperature $T_u$ are emphasized, for example, by color, in relation to a middle range 44, which represents the normal range, for the purpose of identifying the critical range.

In the event of a load drop which is associated with a pressure drop in the variable-pressure operating mode, the setpoint value $T_s$ of the steam temperature at the exit of the evaporator heating surface 6 and, therefore, the temperature window 34 will move towards low temperatures. In normal operation, the actual value $T_i$ will follow the setpoint value $T_s$. In this regard, a temperature difference between the setpoint value $T_s$ and the actual value $T_i$ may increase temporarily as a result of dynamic operations. This is taken into account by the temperature band of the temperature window 34.

We claim:

1. A method for monitoring a feedwater supply to a continuous-flow or once-through steam generator, which comprises the steps of:

measuring an actual value of a steam temperature;

obtaining a setpoint value of the steam temperature from operationally induced parameters; and simultaneously displaying the actual value of the steam temperature and the setpoint value of the steam temperature on a single temperature scale.

2. The method according to claim 1, wherein the operationally induced parameters are selected from the group consisting of a steam generator load, a composition of a fuel supplied to the continuous-flow steam generator, a degree of contamination of heating surfaces of one of an evaporator and a superheater, and a feedwater temperature.

3. The method according to claim 1, wherein the operationally induced parameters is the steam generator capacity or load.

4. Device for monitoring a feedwater supply to an evaporator of a continuous-flow or once-through steam generator, comprising an indicator device connected to a measuring device for obtaining an actual value of the steam temperature, and to a setpoint value transmitter for obtaining a setpoint value of the steam temperature from operationally induced parameters, and a temperature scale at an outlet of the steam generator, said actual value and said setpoint value of the steam temperature being jointly indicatable on said indicator device.

5. The device according to claim 4, including a temperature window for said setpoint value of the steam temperature superposed on said temperature scale.

* * * * *